US008603718B2

(12) United States Patent
Suzuki et al.

(10) Patent No.: US 8,603,718 B2
(45) Date of Patent: Dec. 10, 2013

(54) ANISOTROPIC MAGNETIC MATERIAL-DISPERSED RESIN CARRIER, ELECTROPHOTOGRAPHIC DEVELOPER, AND DEVELOPING DEVICE

(75) Inventors: Kazumi Suzuki, Shizuoka (JP); Masaki Yoshino, Kanagawa (JP); Hisao Kurosu, Kanagawa (JP); Tatsuya Morita, Kanagawa (JP); Tomoko Kino, Kanagawa (JP); Shingo Sakashita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/362,222

(22) Filed: Jan. 31, 2012

(65) Prior Publication Data

US 2012/0202147 A1 Aug. 9, 2012

(30) Foreign Application Priority Data

Feb. 4, 2011 (JP) ..... 2011-023138

(51) Int. Cl.
*G03G 9/00* (2006.01)

(52) U.S. Cl.
USPC ..... 430/111.4; 430/11.3; 430/111.35; 430/111.41

(58) Field of Classification Search
USPC ..... 430/111.35, 111.4, 111.3, 111.41; 399/237
See application file for complete search history.

(56) References Cited

U.S. PATENT DOCUMENTS

| | | | | |
|---|---|---|---|---|
| 5,576,133 | A * | 11/1996 | Baba et al. | 430/111.31 |
| 7,998,283 | B2 * | 8/2011 | Yang | 148/301 |
| 2008/0280224 | A1 | 11/2008 | Inoue et al. | |
| 2009/0186292 | A1 | 7/2009 | Inoue et al. | |
| 2010/0061759 | A1 | 3/2010 | Moriya et al. | |

FOREIGN PATENT DOCUMENTS

| | | |
|---|---|---|
| JP | 59-104663 | 6/1984 |
| JP | 4-3868 | 1/1992 |
| JP | 2984471 | 9/1999 |
| JP | 3005119 | 11/1999 |
| JP | 3005128 | 11/1999 |
| JP | 3044429 | 3/2000 |
| JP | 2009-188044 | 8/2009 |
| JP | 4768294 | 6/2011 |
| WO | WO 84/01837 | 5/1984 |

* cited by examiner

*Primary Examiner* — Thorl Chea
(74) *Attorney, Agent, or Firm* — Cooper & Dunham LLP

(57) ABSTRACT

An anisotropic magnetic material-dispersed resin carrier including: fine magnetic particles; and a binder resin in which at least the fine magnetic particles are dispersed, wherein the anisotropic magnetic material-dispersed resin carrier has a magnetic anisotropy where magnetic fields of the fine magnetic particles are orientated in the same direction, and wherein the anisotropic magnetic material-dispersed resin carrier has a saturation magnetization of 16 emu/g to 30 emu/g, a coercive force of 15 kA/m to 40 kA/m, and a number average particle diameter of 15 μm or more but less than 100 μm.

13 Claims, 4 Drawing Sheets

ANISOTROPIC MAGNETIC MATERIAL-DISPERSED RESIN CARRIER, ELECTROPHOTOGRAPHIC DEVELOPER, AND DEVELOPING DEVICE

BACKGROUND OF THE INVENTION

1. Field of the Invention

The present invention relates to an anisotropic magnetic material-dispersed resin carrier, which is mixed with a toner to constitute a developer for developing electrostatic images, and relates to an electrophotographic developer, and a developing device.

2. Description of the Related Art

Image formation by, for example, electrophotography, electrostatic recording or electrostatic printing is generally performed through a process including: forming a latent electrostatic image on a latent electrostatic image bearing member (hereinafter may be referred to as a "photoconductor" or "electrophotographic photoconductor"); developing the latent electrostatic image with a developer to form a visible image (toner image); transferring the visible image onto a recording medium such as paper; and fixing the visible image on the recording medium to form a fixed image.

The developer includes a one-component developer in which a magnetic or non-magnetic toner is used singly, and a two-component developer containing a toner and a carrier.

In general, carriers contained in such a two-component developer are roughly classified into conductive carriers such as iron powder and so-called insulating carriers. The insulating carriers are made to have a high resistance by coating particles such as iron powder, nickel or ferrite with an insulating resin or dispersing fine magnetic particles in an insulating resin.

Carriers having low resistance leak the potential of latent images to fail to obtain good developed images, and are required to have a resistance equal to or higher than a certain resistance. Therefore, conductive carrier cores are preferably coated with an insulating material in use. As carrier core materials, ferrites are preferably used which have a relatively high resistance.

In general, in case of developers having high magnetic force, magnetic brushes formed of the developer become hard in a developing region where the toner contained in the developer develops latent images, thereby causing brush marks, roughness, etc. which make it difficult to obtain high-quality developed images.

In view of this, ferrites are preferably used for lowering the magnetic force of the formed carrier to obtain high-quality images.

Hitherto, there has been proposed adjusting the saturation magnetization of a carrier to a value of 50 emu/g or lower in order to form high-quality images (see Japanese Patent Application Laid-Open (JP-A) No. 59-104663). This proposal can form good developed images having no image failures called brush marks. The lower the saturation magnetization of a carrier is, the better the reproducibility of thin lines is. As being distanced from the magnetic pole, the carrier problematically adheres in higher degrees to a latent electrostatic image bearing member (e.g., a photoconductor drum) (hereinafter such phenomenon is referred to as "carrier adhesion").

Also, there has been proposed using as a carrier so-called hard ferrite having a coercive force of 300 gauss or more (see Japanese Patent Application Publication (JP-B) No. 04-3868).

However, a developing device is inevitably enlarged to use as a carrier hard ferrite having a high coercive force. It is preferable to employ a developer carrier using a fixed magnetic core in order to realize a compact high-quality color copier. In the compact copiers, the hard ferrite carrier having a high coercive force is poor in transferability due to its self-aggregation property.

In order to solve these problems, there has been proposed a magnetic material-dispersed resin carrier where fine magnetic particles are dispersed in a binder resin, as a carrier preventing carrier adhesion and forming high-quality images (see Japanese Patent (JP-B) No. 3005119). The magnetic material-dispersed resin carrier has low specific gravity to form soft magnetic brushes. It is improved in highlight reproducibility especially in the developing method using an alternating electric field.

However, this magnetic material-dispersed resin carrier cannot sufficiently achieve both desired formation of high-quality developed images and desired prevention of carrier adhesion. Although using this carrier is advantageous in terms of the cost for apparatuses, it still has a problem in achieving both desired solid image uniformity and desired carrier adhesion when used in a developing unit using a direct electric field weaker than an alternating electric field.

SUMMARY OF THE INVENTION

The present invention aims to solve the above-described existing problems and to achieve the following objects. Specifically, an object of the present invention is to provide an electrophotographic carrier capable of realizing high image quality while preventing carrier adhesion and aggregation of a carrier and/or a developer. In particular, an object of the present invention is to provide an electrophotographic carrier having high developing ability to attain solid image uniformity in high-speed printing.

Means for solving the above existing problems are as follows.

An anisotropic magnetic material-dispersed resin carrier of the present invention includes:

fine magnetic particles; and a binder resin in which the fine magnetic particles are dispersed, wherein the anisotropic magnetic material-dispersed resin carrier has a magnetic anisotropy where magnetic fields of the fine magnetic particles are orientated in the same direction, and wherein the anisotropic magnetic material-dispersed resin carrier has a saturation magnetization of 16 emu/g to 30 emu/g, a coercive force of 15 kA/m to 40 kA/m, and a number average particle diameter of 15 μm or more but less than 100 μm.

The present invention can provide: an electrophotographic carrier capable of realizing high image quality while preventing carrier adhesion and aggregation of a carrier and/or a developer; and, in particular, an electrophotographic carrier having high developing ability to attain solid image uniformity in high-speed printing. The carrier of the present invention can solve the above-described existing problems and achieve the above objects.

Figure 1:
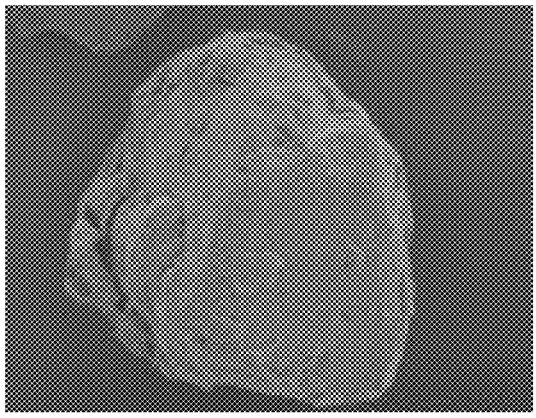
FIG. 1 is a microscopic photographic image of the anisotropic magnetic material-dispersed resin carrier of Example 3.

DETAILED DESCRIPTION OF THE INVENTION (Anisotropic Magnetic Material-Dispersed Resin Carrier)

An anisotropic magnetic material-dispersed resin carrier of the present invention includes: fine magnetic particles; and a binder resin in which at least the fine magnetic particles are dispersed, wherein the anisotropic magnetic material-dispersed resin carrier has a magnetic anisotropy where magnetic fields of the fine magnetic particles are orientated in the same direction, and wherein the anisotropic magnetic material-dispersed resin carrier has a saturation magnetization of 16 emu/g to 30 emu/g, a coercive force of 15 kA/m to 40 kA/m, and a number average particle diameter of 15 μm or more but less than 100 μm. The anisotropic magnetic material-dispersed resin carrier may optionally contain other ingredients than the binder resin and the fine magnetic particles.

Next will be given exemplary materials suitably used for the carrier of the present invention.

<Binder Resin>

The binder resin used for the anisotropic magnetic material-dispersed resin carrier of the present invention is not particularly limited and may be appropriately selected from those known in the art depending on the intended purpose. Examples thereof include thermoplastic resins obtained through polymerization of vinyl monomers.

The vinyl monomer is not particularly limited and may be appropriately selected depending on the intended purpose. Examples thereof include styrene; styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; unsaturated monoolefins such as ethylene, propylene, butylene and isobutylene; unsaturated diolefins such as butadiene and isoprene; halogenated vinyls such as vinyl chloride, vinylidene chloride, vinyl bromide and vinyl fluoride; vinyl esters such as vinyl acetate, vinyl propionate and vinyl benzoate; methacrylic acid and cc-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid and acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, steary acrylate, 2-chloroethyl acrylate and phenyl acrylate; maleic acid and maleic acid half esters; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; vinyl naphthalenes; acrylic acid or methacrylic acid derivatives such as acrylonitrile, mehtacrylonitrile and acrylamide; and acrolein.

These may be polymerized alone or in combination.

Besides the thermoplastic resins obtained through polymerization of the vinyl monomers, further examples of the binder resin include non-vinyl condensated resins such as polyester resins, epoxy resins, phenol resins, urea resins, polyurethane resins, polyimide resins, cellulose resins and polyether resins; and mixtures of these resins and the above vinyl resins.

<Fine Magnetic Particles>

The fine magnetic particles are not particularly limited and may be appropriately selected from those known in the art depending on the intended purpose. They are preferably at least one of rare-earth magnetic powder and anisotropic ferrite magnetic powder.

The rare-earth magnetic powder is not particularly limited and may be appropriately selected depending on the intended purpose. Examples thereof include rare earth-transition metal magnetic powder such as anisotropic SmCo powder, anisotropic SmFeN powder and anisotropic NdFeB powder. In addition, various rare earth-iron-nitrogen magnet powder containing as elements a rare earth, iron and nitrogen may be used since it is a rare earth-transition metal magnet alloy containing as elements a rare earth and a transition metal. The rare-earth magnetic powder preferably contains as the rare earth at least one selected from Sm, Gd, Tb and Ce, more preferably further contains as the rare earth at least one selected from Pr, Nd, Dy, Ho, Er, Tm and Yb.

In particular, Sm-containing fine magnetic particles can remarkably achieve the effects of the present invention.

The rare earth elements may be used alone or in combination. The amount of the rare earth element(s) is preferably 5 at. % to 40 at. %, more preferably 11 at. % to 35 at. %.

The transition metal is not particularly limited and may be appropriately selected depending on the intended purpose. Examples thereof include Fe, Co, Ni and Mn, with Fe being preferred. In particular, fine magnetic particles containing Fe in an amount of 50 at. % to 90 at. % are preferred. Also, part of Fe may be substituted with Co for the purpose of improving the formed magnet in temperature characteristics without impairing magnetic characteristics.

Furthermore, one or more selected from Mn, Ca, Cr, Nb, Mo, Sb, Ge, Zr, V, Si, Al, Ta, Cu, and other elements may be added for the purposes of improving coercive force, increasing productivity and reducing cost. In this case, the amount of such additional element(s) is preferably 7% by mass or less relative to the total amount of the transition element(s).

Moreover, unavoidable impurities such as carbon and boron may be contained in an amount of 5% by mass or lower.

The rare earth-transition metal magnet may be mixed with various magnet powder such as ferrite and alnico which are generally used as raw materials of a bond magnet. This magnet powder preferably has an anisotropic magnetic field (HA) of 50 kOe (4.0 MA/m) or more.

The fine magnetic particles preferably have a number average particle diameter of 0.5 μm to 8 μm, more preferably 1 μm to 3 μm. When the number average particle diameter thereof is less than 0.5 μm, the fine magnetic particles are degraded in processability, especially dispersibility in resin. When it is more than 8 μm, the magnetic material-dispersed powder tends to involve variation in distribution, resulting in variation between the particles in magnetization intensity.

The magnetic anisotropy where magnetic fields of the magnetic particles are orientated in the same direction is preferably provided, for example, in the following manner. Specifically, at least fine magnetic particles are mixed and melt-kneaded with a binder resin and then the resultant bulk or resin powder is left for 10 sec or longer in a magnetic flux density of 2 T (tesla) or higher.

The anisotropy of the anisotropic magnetic material-dispersed resin carrier of the present invention means that the magnetisms of particles of a resin containing fine magnetic particles dispersed therein are oriented in the same direction.

When measuring the saturation magnetization of resin particles the magnetisms of which are oriented in different directions, it is necessary to orient the magnetisms of the resin particles in the same direction. Thus, the magnetism of the carrier of the present invention is measured as follows.

First, a cell having a volume of 5.655 $cm^3$ (cc) is charged with the carrier in substantially the closest packed state and closed with a cap to prepare a first sample. Then, the amount of the carrier charged in the first sample is measured. Next, another cell is charged with the carrier in an amount of 75% by mass of the amount of the carrier in the first sample and closed with a cap to prepare a sample (a second sample). Further, another cell is charged with the carrier in an amount of 50% by mass of the amount of the carrier in the first sample and closed with a cap to prepare a sample (a third sample).

Each of these samples is set in a sample holder of VSM-C7-10A (product of TOEI INDUSTRY CO., LTD.) and measured for hysteresis curve at a magnetic field of ±5 kOe.

When the carrier having magnetic anisotropy is charged in the closest packed state, it cannot rotate in the direction of the magnetic field, resulting in that the maximum value is not observed. In other words, when the carrier has magnetic anisotropy, the second or third sample has a higher saturation magnetization than the first sample in which the carrier is charged in the closest packed state. That is, in the case of the anisotropic magnetic material-dispersed resin carrier of the present invention, the second or third sample has a higher saturation magnetization than the first sample in which the carrier is charged in the closest packed state.

The saturation magnetization of the anisotropic magnetic material-dispersed resin carrier of the present invention is 16 emu/g to 30 emu/g when the carrier is charged in an amount of 75% by mass of the amount of the carrier charged in the closest packed state. When the saturation magnetization thereof is lower than 16 emu/g, the magnetization is insufficient to cause carrier adhesion. When the saturation magnetization thereof is higher than 30 emu/g, the carrier and the developer easily aggregate.

The residual magnetization of the anisotropic magnetic material-dispersed resin carrier of the present invention is equal to or higher than 50% of the saturation magnetization. When the residual magnetization is lower than 50% of the saturation magnetization, magnetic characteristics as a ferromagnet are insufficient to easily cause problems in durability and stability.

The coercive force of the anisotropic magnetic material-dispersed resin carrier of the present invention is 15 kA/m to 40 kA/m. When the coercive force thereof is 15 kA/m or higher, it is possible to prevent the occurrence of carrier adhesion. When it is 40 kA/m or lower, it is hard to cause entrainment occurring on the developing sleeve.

The ratio by mass of the binder resin to the fine magnetic particles (i.e., binder resin/fine magnetic particles) is not particularly limited and may be appropriately selected depending on the intended purpose, but is preferably 65/35 to 80/20. When the above ratio by mass is less than 65/35, the specific resistance becomes too low. When it is more than 80/20, the amount of the magnetic material is insufficient to potentially lead to insufficient intensity of magnetism.

The specific resistance of the anisotropic magnetic material-dispersed resin carrier of the present invention is not particularly limited and may be appropriately selected depending on the intended purpose, but is preferably $10^8$ Ω·cm to $10^{13}$ Ω·cm. When the specific resistance is less than $10^8$ Ω·cm, leakage of current from the sleeve to the photoconductor surface easily occurs in the developing region when employing the developing method of applying bias voltage, making is difficult to form good images. When it is higher than $10^{13}$ Ω·cm, a charge-up phenomenon easily occurs under low-humidity conditions, causing image degradation such as low image density, transfer failure and fogging.

The specific resistance changes depending on the mixing ratio of the magnetic material and the dispersion state of the magnetic material. To adjust the resistance, fine conductive particles such as carbon black and titanium oxide may be kneaded and dispersed in the binder resin.

The average circularity of the anisotropic magnetic material-dispersed resin carrier of the present invention is not particularly limited and may be appropriately selected depending on the intended purpose, but is preferably 0.85 to 0.94. When the average circularity thereof is lower than 0.85, the flowability of the carrier tends to decrease and also the carrier is easily broken. When it is higher than 0.94, the self-aggregated carrier becomes difficult to return to a non-aggregated state since the carrier of the present invention is ferromagnetic.

The average circularity can easily be adjusted by pulverizing the carrier into particles having a predetermined diameter using a pulverizer such as a ball mill and a jet mill.

The number average particle diameter of the anisotropic magnetic material-dispersed resin carrier of the present invention is 15 μm or more but less than 100 μm, preferably 15 μm to 80 μm. When the number average particle diameter thereof is less than 15 μm, the self-aggregated carrier may become difficult to return to a non-aggregated state or carrier adhesion onto the photoconductor may easily occur. When it is 100 μm or more, magnetic brushes in the development pole become coarse to be hard to obtain high-quality images.

The average circularity and the number average particle diameter can be measured with FPIA3000 (product of SYSMEX CORPORATION).

The anisotropic magnetic material-dispersed resin carrier of the present invention is preferably produced through a process including: a step of melt-kneading fine magnetic particles in a binder resin; a step of pulverizing and/or classifying the resultant kneaded product so as to have a predetermined particle diameter; and a step of applying a magnetic field of 2 T (tesla) or more to the pulverized and/or classified magnetic material-dispersed resin particles for 10 sec or longer at a temperature equal to or lower than the glass transition temperature of the binder resin. Notably, the upper limit of the magnetic field is preferably 10 T.

The step of melt-kneading fine magnetic particles in a binder resin is a step of melt-kneading the magnetic material with the binder resin using, for example, a two open-roll kneader or a biaxially kneader extruder. The melt-kneading temperature is preferably equal to or lower than 10° C.+the softening point Tm of the resin.

The step of pulverizing and/or classifying the resultant kneaded product is a step in which the kneaded product obtained in the melt-kneading step is cooled to a temperature equal to or lower than the glass transition temperature of the resin and then coarsely pulverized, and further pulverized to a predetermined particle diameter using a pulverizer such as a ball mill or a jet mill; and optionally, the fine particles and coarse particles are classified to an intended granularity using, for example, a sieve, an elbow-jet classifier or a cyclone classifier.

The magnetic material-dispersed powder produced through the above step is charged into a non-magnetic container, and is subjected to a step in which a uniform parallel magnetic field having a magnetic flux density of 2 T or more is applied to the magnetic material-dispersed powder for 10 sec or longer at a temperature equal to or lower than the glass transition temperature of the resin using a high magnetic field application apparatus (product of Sumitomo Heavy Industries, Ltd.). As a result, the magnetic material dispersed in the resin is provided with magnetic anisotropy.

(Electrophotographic Developer)

An electrophotographic developer of the present invention includes: the anisotropic magnetic material-dispersed resin carrier of the present invention; and a toner. The anisotropic magnetic material-dispersed resin carrier of the present invention allows the electrophotographic developer to be suppressed in carrier adhesion and form high-quality images.

<Toner>

The toner is not particularly limited and may be appropriately selected depending on the intended purpose from those known in the art used as an electrophotographic toner. The toner contains at least a binder resin and a colorant; and, if necessary, further contains a releasing agent, a charge controlling agent and other components.

The amount of the toner contained in the developer is preferably 2.0 parts by mass to 12.0 parts by mass, more preferably 2.5 parts by mass to 10 parts by mass, relative to 100 parts by mass of the carrier.

(Developing Device)

A developing device of the present invention includes the electrophotographic developer of the present invention.

Figure 2:
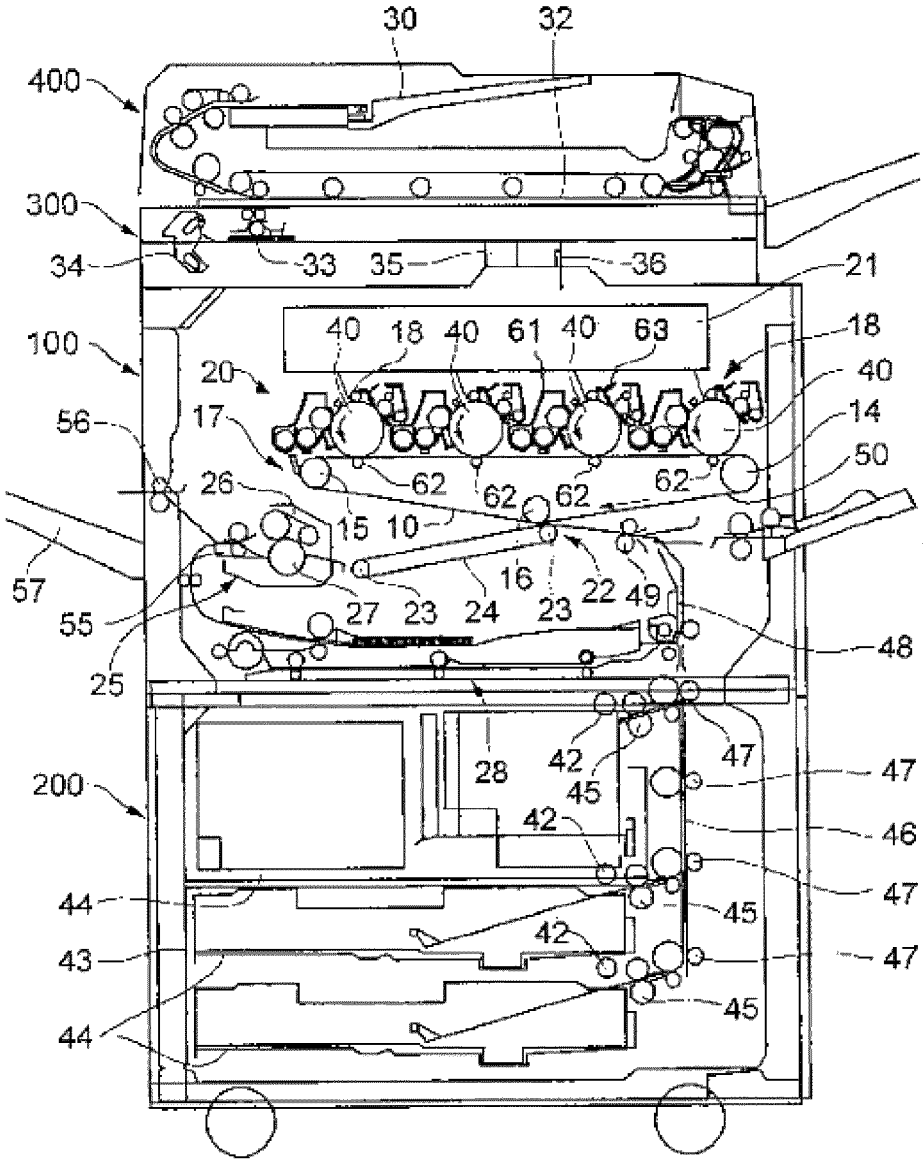
FIG. 2 is a structural view of the configuration inside a color image forming apparatus containing a developing device of the present invention.

FIG. 2 is a structural view of the configuration inside a color image forming apparatus containing the developing device of the present invention. Although this specific example is an electrophotographic copier employing a tandem-type, indirect transfer process, the developing device of the present invention is applicable to any electrophotographic process using a two-component developer and is not limited to this specific example. In FIG. 2, reference numeral 100 denotes a copier main body, reference numeral 200 denotes a paper feed table for mounting the copier main body 100, reference numeral 300 denotes a scanner (reading optical system) which is arranged over the copier main body 100, and reference numeral 400 denotes an automatic document feeder (ADF) which is arranged over the scanner 300.

The copier main body 100 is provided at the center with an endless belt intermediate transfer member 10 laterally extending. In FIG. 2, the intermediate transfer member is stretched around support rollers 14, 15, and 16 and is rotatable clockwise in this figure. An intermediate transfer member cleaning unit 17 for removing toner remaining after image formation on the intermediate transfer member 10 is provided near the second support roller 15 of the three support rollers. A tandem image forming unit 20 is configured to have four image forming units 18 for yellow, cyan, magenta, and black, which face the intermediate transfer member 10 stretched around the first support roller 14 and the second support roller 15 of the three support rollers, and are arranged side by side in the transfer direction thereof. Furthermore, an exposing unit 21 is provided over the tandem image forming section 20 as shown in FIG. 2.

A secondary transfer device 22 is provided opposite to the tandem image forming section 20 via the intermediate transfer member 10. The secondary transfer device 22 has an endless secondary transfer belt 24 stretched around a pair of rollers 23, and is arranged so as to be pressed against the third support roller 16 via the intermediate transfer member 10, thereby transferring an image carried on the intermediate transfer member 10 onto a sheet. A fixing device 25 configured to fix the transferred image on the sheet is provided near the secondary transfer device 22. The fixing device 25 has an endless fixing belt 26 and a pressure roller 27 pressed against the fixing belt 26. The secondary transfer unit 22 includes a sheet conveyance function in which the sheet on which the image has been transferred is conveyed to the fixing device 25. Notably, a sheet inversion device 28 for inverting a sheet to form images on both sides thereof is provided parallel to the tandem image forming unit 20 and under the secondary transfer device 22 and fixing device 25.

At first, a document is placed on a document table 30 of an automatic document feeder 400, when a copy is made using this color electrophotographic apparatus. Alternatively, the automatic document feeder 400 is opened, the document is placed onto a contact glass 32 of the scanner 300, and the automatic document feeder 400 is closed. When a start switch (not shown) is pressed, a document placed on the automatic document feeder 400 is conveyed onto the contact glass 32. When the document is initially placed on the contact glass 32, the scanner 300 is immediately driven to operate a first carriage 33 and a second carriage 34. At the first carriage 33, light is applied from a light source to the document, and reflected light from the document is further reflected toward the second carriage 34. The reflected light is further reflected by a mirror of the second carriage 34 and passes through image-forming lens 35 into a read sensor 36 to thereby read the document. When the start switch is pressed, a drive motor (not shown) drives one of the support rollers 14, 15 and 16 to rotate to result in causing the other two support rollers to rotate by the rotation of the driven support roller, to thereby rotate the intermediate transfer member 10. Simultaneously, the individual image forming units 18 respectively rotate their photoconductors 40 to thereby form black, yellow, magenta, and cyan monochrome images thereon. With the conveyance of the intermediate transfer member 10, the monochrome images are sequentially transferred onto the intermediate transfer member to form a composite color image on the intermediate transfer member 10. Separately, when the start switch (not shown) is pressed, one of feeder rollers 42 of the feeder table 200 is selectively rotated, sheets are ejected from one of multiple feeder cassettes 44 in a paper bank 43 and are separated in a separation roller 45 one by one into a feeder path 46, are transported by a transport roller 47 into a feeder path 48 in the copier main body 100 and are bumped against a registration roller 49. The registration roller 49 is rotated synchronously with the movement of the composite color image on the intermediate transfer member 10 to transport the sheet into between the intermediate transfer member 10 and the secondary transfer unit 22, and the composite color image is transferred onto the sheet by the secondary transfer unit 22 to thereby form a color image. The sheet on which the image has been transferred is conveyed by the secondary transfer device 22 into the fixing device 25, is given heat and pressure in the fixing device 25 to fix the transferred image, changes its direction by a switch claw 55, and is ejected by an ejecting roller 56 to be stacked on an output tray 57. Alternatively, the moving direction of the paper is changed by the switching claw 55, and the paper is conveyed to the sheet inversion unit 28 where it is inverted, and guided again to the transfer position in order that an image is formed also on the back surface thereof, then the paper is ejected by the ejecting roller 56 and stacked on the output tray 57. The intermediate transfer member 10 after the image transfer, the toner, which remains on the intermediate transfer member 10 after the image transfer, is removed by the intermediate transfer member cleaning device 17, and the intermediate transfer member 10 is ready for the next image formation in the tandem image forming section 20.

Figure 3:
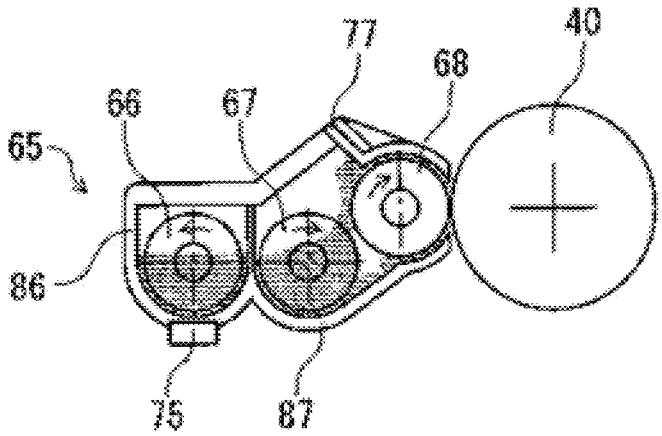
FIG. 3 is a structural view of the configuration inside a developing device of the present invention.
Figure 4:
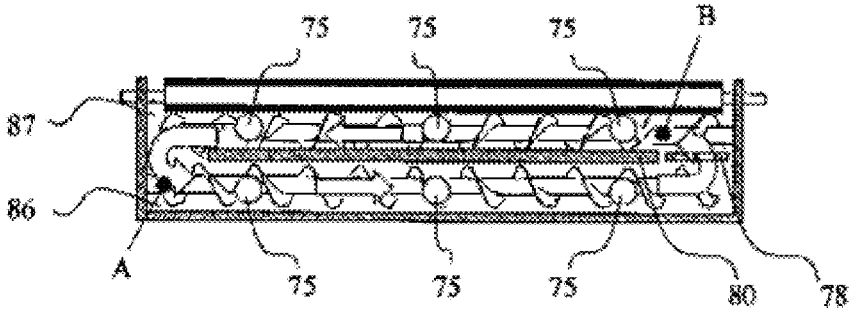
FIG. 4 is a structural view of the configuration inside a developing device of the present invention.

Each image forming unit 18 of the tandem image forming section 20 has, around the drum-shaped photoconductor 40, a charging device 60, a developing device 61, a primary transfer device 62, and other members. A photoconductor cleaning device 63 has at least a blade cleaning member. As illustrated in FIG. 3, the developing device 61 has, in a developer container 65, a toner-supply-side stirring screw 66 serving as a unit configured to stir and convey the developer, a developer-carry-side stirring screw 67, a developer carrier (developing roller) 68 and a doctor blade 77. The wall of a first developer-stirring chamber 86 is provided with a supply port through which a toner is supplied from a toner supplying device. The toner-supply-side stirring screw 66 stirs and conveys the toner supplied from the toner supplying device and the developer in the developer container 65 (a two-component developer containing magnetic particles and toner). The stirring screw 67 in a second developer-stirring chamber 87 (developer-carry-side) stirs and conveys the developer in the developer container 65 (hereinafter the second developer-stirring chamber is referred to as "developer-side chamber"). As illustrated in FIG. 4, the supply-side chamber and the developer-side chamber are partitioned with a partition plate 80, and openings through which the developer passes are provided at both ends thereof. The developer in the developer-stirring chamber is drawn up to the developing sleeve, is regulated in amount with a doctor blade, and is supplied to a sliding portion with the photoconductor serving as a latent image bearing member. At this time, the developer is given the most sliding force by the doctor blade.

Figure 5:
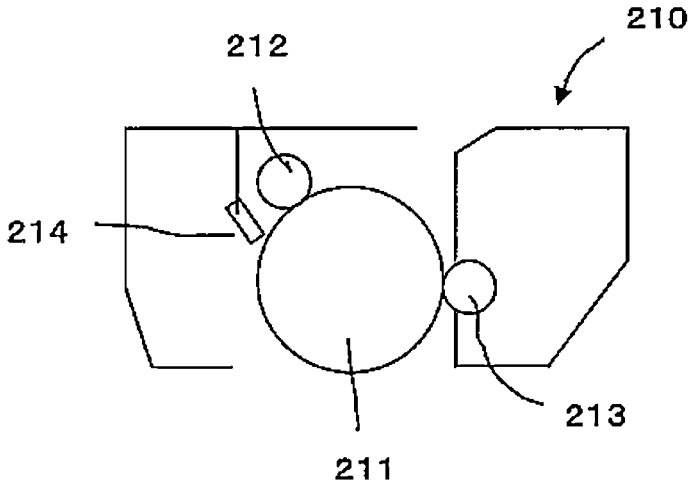
FIG. 5 is a schematic structural view of a process cartridge using a developing device of the present invention.

FIG. 5 is a schematic structural view of a process cartridge using the developing device of the present invention. In FIG. 5, reference numeral 210 denotes a process cartridge, 211 denotes a photoconductor, 212 denotes a charging unit, 213 denotes a developing unit, and 214 denotes a cleaning unit.

In the present invention, two or more of constituent members such as the above photoconductor 211, charging unit 212, developing unit 213 and cleaning unit 214 are integrally formed into a process cartridge which is detachably mounted in the main body of an image forming apparatus such as a copier or a printer.

In the image forming apparatus containing the process cartridge using the developing device of the present invention, the photoconductor is rotated at a predetermined circumferential speed. While being rotated, the photoconductor is uniformly positively or negatively charged at a predetermined potential with the charging unit. Subsequently, the thus-charged photoconductor is imagewise exposed to light emitted from an imagewise exposing unit (e.g., slit exposure and laser beam scanning exposure), to thereby form a latent electrostatic image. The thus-formed latent electrostatic image is developed using toner with the developing unit. The thus-developed toner image is transferred with the transfer unit onto an image-receiving medium which is fed from a paper-feed portion to between the photoconductor and the transfer unit in synchronization with rotation of the photoconductor. The image-receiving medium having undergone image transfer is separated from the photoconductor and fed into the fixing unit for image fixing. The formed printed product (copy) is discharged outside the image forming apparatus. The photoconductor surface after image transfer is cleaned with the cleaning unit containing at least a blade cleaning member for removing the residual toner to provide a clean surface, followed by charge elimination. The thus-treated photoconductor is used for the subsequent electrophotographic process.

EXAMPLES

The present invention will next be described in more detail by way of Examples and Comparative Examples. The present invention, however, is not construed as being limited to Examples.

Comparative Example 1

Preparation of Kneaded Product of Magnetic Material

A styrene-butyl acrylate copolymer (glass transition temperature Tg: 62° C., weight average molecular weight Mw: 156,000) (72 parts by mass) and SmFeN (Wellmax-S3A, product of SUMITOMO METAL MINING CO., LTD., resin content: 10% by mass, average particle diameter: 1 μm) (28 parts by mass) were thoroughly mixed together. The resultant mixture was kneaded by being passed twice through an open roll kneader (KNEADEX, product of NIPPON COKE & ENGINEERING, CO., LTD.) under the following conditions: front-roller-supply side: 140° C., front-roller-discharge side: 50° C., back-roller-supply side: 100° C., back-roller-discharge side: 40° C., front roller rotation speed: 35 rpm, back roller rotation speed: 31 rpm, and gap: 0.25 mm, followed by pulverizing with a pulverizer (product of HOSOKAWA MICRON CORPORATION) to thereby obtain a kneaded product of a magnetic material.

Production of Magnetic Material-Dispersed Resin Powder

The thus-obtained kneaded product of a magnetic material was pulverized for 60 hours with a ball mill pulverizer (V1-ML, product of IRIE SHOKAI Co., Ltd.) at 46 rpm under the following conditions: the amount of balls filled: 1.5 L and ball size: 500 μm, 3.8 kg. The pulverized product was classified with an elbow-jet classifier (product of Nittetsu Mining Co., Ltd.) to thereby obtain a magnetic material-dispersed resin powder having a number average particle diameter of 10 μm. Notably, the number average particle diameter was measured with FPIA3000 (product of SYSMEX CORPORATION).

Provision of Magnetic Anisotropy

The thus-classified magnetic material-dispersed resin powder was placed in a glass cylindrical container having a diameter of 30 mm, and left for 5 min in a magnetic flux density of 8 T using a high magnetic field application apparatus (product of Sumitomo Heavy Industries, Ltd.) to thereby obtain anisotropic magnetic material-dispersed resin carrier A.

Notably, the following method was employed to judge whether the obtained carrier had a magnetic anisotropy in which the magnetic field had been oriented in the same direction.

First, a cell having a volume of 5.655 $cm^3$ (cc) was charged with the carrier A in substantially the closest packed state and closed with a cap to prepare a sample (a first sample). The amount of the carrier A charged in the first sample was found to be 0.0425 g. Next, another cell was charged with the carrier in an amount of 75% by mass of the amount of the carrier in the first sample and closed with a cap to prepare a sample (a second sample). Further, another cap was charged with the carrier in an amount of 50% by mass of the amount of the carrier in the first sample and closed with a cap to prepare a sample (a third sample).

Each of these samples was set in a sample holder of a magnetization meter VSM-C7-10A (product of TOEI INDUSTRY CO., LTD.) and measured for hysteresis curve at a magnetic field of ±5 kOe.

As a result, the first, second and third samples charged with the carrier A were found to be 7.26 emu/g, 20.21 emu/g and 23.82 emu/g, respectively.

Here, when the carrier having magnetic anisotropy is charged in the closest packed state, it cannot rotate in the direction of the magnetic field, resulting in that the maximum value is not observed. In other words, when the carrier has magnetic anisotropy, the second or third sample has a higher saturation magnetization than the first sample which is charged with the carrier in the closest packed state.

In this manner, it was confirmed that the carrier A had magnetic anisotropy.

Example 1

The procedure of Comparative Example 1 was repeated, except that the number average particle diameter of the anisotropic magnetic material-dispersed resin carrier was changed from 10 μm to 16 μm, to thereby obtain anisotropic magnetic material-dispersed resin carrier B.

Example 2

The procedure of Comparative Example 1 was repeated, except that the number average particle diameter of the anisotropic magnetic material-dispersed resin carrier was changed from 10 μm to 36 μm, to thereby obtain anisotropic magnetic material-dispersed resin carrier C.

Example 3

The procedure of Comparative Example 1 was repeated, except that the number average particle diameter of the anisotropic magnetic material-dispersed resin carrier was changed from 10 μm to 50 μm, to thereby obtain anisotropic magnetic material-dispersed resin carrier D. FIG. 1 is a microscopic photographic image of the anisotropic magnetic material-dispersed resin carrier D.

Example 4

The procedure of Comparative Example 1 was repeated, except that the number average particle diameter of the anisotropic magnetic material-dispersed resin carrier was changed from 10 μm to 80 μm, to thereby obtain anisotropic magnetic material-dispersed resin carrier E.

Comparative Example 2

The procedure of Comparative Example 1 was repeated, except that the number average particle diameter of the anisotropic magnetic material-dispersed resin carrier was changed from 10 μm to 100 μm, to thereby obtain anisotropic magnetic material-dispersed resin carrier F.

Comparative Example 3

The procedure of Example 2 was repeated, except that the mixing ratio by mass of the binder resin to the fine magnetic particles (resin/magnetic material) was changed from 75/25 to 60/40, to thereby obtain anisotropic magnetic material-dispersed resin carrier G.

Example 5

The procedure of Example 2 was repeated, except that the mixing ratio by mass of the binder resin to the fine magnetic particles (resin/magnetic material) was changed from 75/25 to 70/30, to thereby obtain anisotropic magnetic material-dispersed resin carrier H.

Example 6

The procedure of Example 2 was repeated, except that the mixing ratio by mass of the binder resin to the fine magnetic particles (resin/magnetic material) was changed from 75/25 to 80/20, to thereby obtain anisotropic magnetic material-dispersed resin carrier I.

Comparative Example 4

The procedure of Example 2 was repeated, except that the mixing ratio by mass of the binder resin to the fine magnetic particles (resin/magnetic material) was changed from 75/25 to 85/15, to thereby obtain anisotropic magnetic material-dispersed resin carrier J.

Example 7

The procedure of Example 2 was repeated, except that the classified magnetic material-dispersed resin powder was further treated with hot air of 300° C. using a suffusion system (product of Nippon Pneumatic Mfg. Co., Ltd.) to make the magnetic material-dispersed resin powder have an average circularity of 0.98, to there by obtain anisotropic magnetic material-dispersed resin carrier K.

Example 8

The procedure of Example 2 was repeated, except that the magnetic flux density of the high magnetic field application apparatus was changed from 8 T to 2 T, to thereby obtain anisotropic magnetic material-dispersed resin carrier L.

Comparative Example 5

The procedure of Example 2 was repeated, except that the magnetic flux density of the high magnetic field application apparatus was changed from 8 T to 0.1 T, to thereby obtain anisotropic magnetic material-dispersed resin carrier M.

Example 9

The procedure of Example 2 was repeated, except that the magnetic material was changed from SmFeN to $Sm_2Co_{17}$ (Wellmax-PH, product of SUMITOMO METAL MINING CO., LTD., resin content: 10% by mass, average particle diameter: 1 μm), to thereby obtain anisotropic magnetic material-dispersed resin carrier N.

Comparative Example 6

Carrier O was produced by coating spherical ferrite particles having an average particle diameter of 35 μm (serving as a carrier core material, product of POWDER TECH CO., MFL-35S) with a mixture of a silicone resin and a melamine resin (serving as a coating material, product of Dow Corning Toray Co., Ltd.).

The properties of the above-obtained anisotropic magnetic material-dispersed resin carriers A to O are shown below.

Notably, the number average particle diameter or the average circularity was measured as a number average of measurements obtained using FPIA3000 (product of SYSMEX CORPORATION). Also, the saturation magnetization and the coercive force were measured as described above using VSM-C7-10A (product of TOEI INDUSTRY CO., LTD.). Here, the saturation magnetization of each anisotropic magnetic material-dispersed resin carrier was a measurement obtained when the amount of the carrier charged was 75% by mass of the amount of the carrier charged in the closest packed state.

TABLE 1

| | | Ratio by mass (Resin/ Magnetic material) | Number avg. particle diameter after classification (μm) | Avg. circularity | Magnetic flux density applied (T) | Presence or absence of magnetic anisotropy | Saturation magnetization (emu/g) | Coersive force (kA/m) |
|---|---|---|---|---|---|---|---|---|
| Comp. Ex. 1 | Carrier A | 75/25 | 10 | 0.94 | 8 | Presence | 20.2 | 28.6 |
| Ex. 1 | Carrier B | 75/25 | 16 | 0.92 | 8 | Presence | 20.5 | 30.5 |
| Ex. 2 | Carrier C | 75/25 | 36 | 0.91 | 8 | Presence | 19.8 | 31.2 |
| Ex. 3 | Carrier D | 75/25 | 50 | 0.88 | 8 | Presence | 21 | 30 |
| Ex. 4 | Carrier E | 75/25 | 80 | 0.85 | 8 | Presence | 18.6 | 30.2 |
| Comp. Ex. 2 | Carrier F | 75/25 | 100 | 0.86 | 8 | Presence | 18.2 | 30.3 |
| Comp. Ex. 3 | Carrier G | 60/40 | 36 | 0.92 | 8 | Presence | 34 | 41.3 |
| Ex. 5 | Carrier H | 70/30 | 36 | 0.92 | 8 | Presence | 28.1 | 36.5 |
| Ex. 6 | Carrier I | 80/20 | 36 | 0.92 | 8 | Presence | 16.2 | 15.5 |
| Comp. Ex. 4 | Carrier J | 85/15 | 36 | 0.92 | 8 | Presence | 12.3 | 11.6 |
| Ex. 7 | Carrier K | 75/25 | 36 | 0.98 | 8 | Presence | 20.3 | 29.6 |
| Ex. 8 | Carrier L | 75/25 | 36 | 0.92 | 2 | Presence | 19.2 | 30.4 |
| Comp. Ex. 5 | Carrier M | 75/25 | 36 | 0.92 | 0.1 | Presence | 6.8 | 11.6 |
| Ex. 9 | Carrier N | 75/25 | 36 | 0.9 | 8 | Presence | 24.3 | 32.6 |
| Comp. Ex. 6 | Carrier O | — | 36 | 0.98 | — | Absence | 70 | 0.08 |

* The fine magnetic particles of carriers A to M were SmFeN, and the fine magnetic particles of carrier N was $Sm_2Co_{17}$.

Each of the carriers A to O was mixed with a yellow toner for IMAGIO MPC4500 (product of Ricoh Company, Ltd.) so that the carrier was covered with the toner at a coverage rate of 28%, to thereby obtain electrophotographic developers A to O.

Notably, the coverage rate of the carrier with the toner can be calculated by the following equation.

Coverage rate of carrier with toner(%)=projected area of toner/surface area of carrier(converted to a sphere)

The obtained electrophotographic developers A to O were used to form images in a modified machine which had been obtained by modifying color complex machine IMGIO MPC4500 (product of Ricoh Company, Ltd.) so that the members such as the developing device and the fixing device could be driven independently of each other. Notably, the development gap was set to 300 μm, the circumferential velocity of the photoconductor was set to 77 mm/s, and the circumferential velocity of the developing sleeve was set to 138.4 mm/s.

Evaluation

The electrophotographic developers A to O were evaluated as follows.

<<Reproducibility in Half-Tone Portion and Carrier Adhesion (1)>>

Each of the electrophotographic developers was used to print out 10 sheets of POD GLOSS (product of Oji paper Co., Ltd.) having a dither pattern of 1,200 dpi and 16 gradation. After the developing unit of the color complex machine had been rotated for 3 hours without printing, 10 sheets having a dither pattern of 472 dot per cm (1,200 dpi) and 16 gradation were printed out in the same manner. These printed images were visually compared with each other to evaluate reproducibility in the half-tone portion according to the following evaluation criteria.

—Evaluation Criteria—

A: High reproducibility

B: Irregularities were slightly observed but caused no problem in practical use

C: Irregularities were observed.

After completion of the above printing, carrier adhesion was visually observed and evaluated according to the following evaluation criteria.

—Evaluation Criteria—

A: No adhesion was observed

B: Adhesion was partially observed but caused no image failures

C: Adhesion was observed and caused image failures such as voids

<<Uniformity of Solid Image and Carrier Adhesion (2)>>

Each of the electrophotographic developers was used to continuously print out 5 sheets of Type 6000 A4 paper (product of Richo Company, Ltd.) having a solid image with a toner deposition amount of 0.6 mg/cm$^2$ and evaluated for solid image uniformity according to the following evaluation criteria.

—Evaluation Criteria for Solid Image Uniformity—

A: Variation in ID<0.1

B: Variation in ID<0.3

C: 0.3≤variation in ID

Notably, the variation in ID was measured as follows. Specifically, each of the five sheets having the solid image was divided into 9 areas which were measured for ID with X-Rite914. Variation in 45 IDs in total was used as the variation in ID.

After completion of the above printing, carrier adhesion was visually observed and evaluated according to the following evaluation criteria.

—Evaluation Criteria—

A: No adhesion was observed

B: Adhesion was partially observed but caused no image failures

C: Adhesion was observed and caused image failures such as voids

<<Aggregation in Developing Device>>

After the above evaluation for half-tone reproducibility and solid image uniformity, the complex machine was operated without printing to visually observe flowability of the developer in the developing device and the presence or absence of aggregates and evaluate them according to the following criteria. The results are shown in Table 2.

—Evaluation Criteria—

A: No aggregates were observed in the developer

B: Aggregates were observed in the developer but immediately separated

C: Aggregates were observed in the developer and impeded circulation in the developing device or resided in a part of the developing device <<Overall Evaluation>>

On the basis of the above evaluations, the carriers A to O were totally evaluated according to the following evaluation criteria.

A: Good

C: Bad (problematic in practical use)

The results are shown in Table 2.

TABLE 2

| | | Half-tone reproducibility | Carrier adhesion (1) | Solid image uniformity | Carrier adhesion (2) | Aggregation in developing device | Overall evaluation |
|---|---|---|---|---|---|---|---|
| Comp. Ex. 1 | Carrier A | A | C | B | C | C | C |
| Ex. 1 | Carrier B | A | A | A | A | A | A |
| Ex. 2 | Carrier C | A | A | A | A | A | A |
| Ex. 3 | Carrier D | A | A | A | A | A | A |
| Ex. 4 | Carrier E | B | A | B | A | A | A |
| Comp. Ex. 2 | Carrier F | C | A | C | A | A | C |
| Comp. Ex. 3 | Carrier G | B | A | B | A | C | C |
| Ex. 5 | Carrier H | A | A | A | A | A | A |
| Ex. 6 | Carrier I | A | A | A | A | A | A |
| Comp. Ex. 4 | Carrier J | A | C | B | C | A | C |
| Ex. 7 | Carrier K | A | A | A | A | B | A |
| Ex. 8 | Carrier L | A | A | A | A | A | A |
| Comp. Ex. 5 | Carrier M | C | C | C | C | C | C |
| Ex. 9 | Carrier N | A | A | A | A | A | A |
| Comp. Ex. 6 | Carrier O | C | A | C | A | A | C |

The embodiments of the present invention are as follows.

<1> An anisotropic magnetic material-dispersed resin carrier, including:

fine magnetic particles; and a binder resin in which at least the fine magnetic particles are dispersed, wherein the anisotropic magnetic material-dispersed resin carrier has a magnetic anisotropy where magnetic fields of the fine magnetic particles are orientated in the same direction, and wherein the anisotropic magnetic material-dispersed resin carrier has a saturation magnetization of 16 emu/g to 30 emu/g, a coercive force of 15 kA/m to 40 kA/m, and a number average particle diameter of 15 μm or more but less than 100 μm.

<2> The anisotropic magnetic material-dispersed resin carrier according to <1>, wherein a ratio by mass of the binder resin to the fine magnetic particles is 65/35 to 80/20.

<3> The anisotropic magnetic material-dispersed resin carrier according to <1> or <2>, wherein the anisotropic magnetic material-dispersed resin carrier has an average circularity of 0.85 to 0.94.

<4> The anisotropic magnetic material-dispersed resin carrier according to any one of <1> to <3>, wherein the fine magnetic particles are a rare earth magnet powder containing a rare earth, iron, and nitrogen as elements.

<5> The anisotropic magnetic material-dispersed resin carrier according to <4>, wherein the fine magnetic particles are SmFeN.

<6> The anisotropic magnetic material-dispersed resin carrier according to any one of <1> to <5>, wherein the carrier is obtained by a method containing melt-kneading at least the fine magnetic particles in the binder resin to prepare a molded product, and leaving the molded product in a magnetic flux density of 2 T or more for 10 sec or longer.

<7> An electrophotographic developer including:

the anisotropic magnetic material-dispersed resin carrier according to any one of <1> to <6>.

<8> A developing device including:

the electrophotographic developer according to <7>.

The anisotropic magnetic material-dispersed resin carrier of the present invention is capable of realizing high image quality while preventing carrier adhesion; and, in particular, can suitably used as a carrier for a two-component electrophotographic developer having high developing ability to attain solid image uniformity in high-speed printing. Furthermore, an electrophotographic developer containing the above carrier can suitably be used in a developing device.

This application claims priority to Japanese application No. 2011-023138, filed on Feb. 4, 2011, and incorporated herein by reference.

What is claimed is:

1. An anisotropic magnetic material-dispersed resin carrier, comprising:

fine magnetic particles; and a binder resin in which at least the fine magnetic particles are dispersed, wherein the anisotropic magnetic material-dispersed resin carrier has a magnetic anisotropy where magnetic fields of the fine magnetic particles are orientated in a same direction, and wherein the anisotropic magnetic material-dispersed resin carrier has a saturation magnetization of 16 emu/g to 30 emu/g, a coercive force of 15 kA/m to 40 kA/m, and a number average particle diameter of 15 μm or more but less than 100 μm.

2. The anisotropic magnetic material-dispersed resin carrier according to claim 1, wherein a ratio by mass of the binder resin to the fine magnetic particles is 65/35 to 80/20.

3. The anisotropic magnetic material-dispersed resin carrier according to claim 1, wherein the anisotropic magnetic material-dispersed resin carrier has an average circularity of 0.85 to 0.94.

4. The anisotropic magnetic material-dispersed resin carrier according to claim 1, wherein the fine magnetic particles are a rare earth magnetic powder containing a rare earth, iron, and nitrogen as elements.

5. The anisotropic magnetic material-dispersed resin carrier according to claim 1, wherein the fine magnetic particles are SmFeN.

6. The anisotropic magnetic material-dispersed resin carrier according to claim 1, wherein the carrier is obtained by a method containing melt-kneading the fine magnetic particles in the binder resin to prepare a molded product, and leaving the molded product in a magnetic flux density of 2T or more for 10 sec or longer.

7. The anisotropic magnetic material-dispersed resin carrier according to claim 1, wherein the fine magnetic particles comprise a rare earth magnetic powder.

8. The anisotropic magnetic material-dispersed resin carrier according to claim 7, wherein the rare earth powder contains a rare earth element in an amount of 5 at. % to 40 at. %.

9. The anisotropic magnetic material-dispersed resin carrier according to claim 1, wherein the fine magnetic particles have a number average particle diameter of 0.5 μm or more but less than 8 μm.

10. An electrophotographic developer comprising:

an anisotropic magnetic material-dispersed resin carrier which contains:

magnetic particles; and a binder resin in which at least the magnetic particles are dispersed, wherein the anisotropic magnetic material-dispersed resin carrier has a magnetic anisotropy where magnetic fields of the magnetic particles are orientated in a same direction, and wherein the anisotropic magnetic material-dispersed resin carrier has a saturation magnetization of 16 emu/g to 30 emu/g, a coercive force 20 of 15 kA/m to 40 kA/m, and a number average particle diameter of 15 μm or more but less than 100 μm.

11. The electrophotographic developer according to claim 10, wherein the magnetic particles comprise a rare earth magnetic powder.

12. A developing device comprising:

an electrophotographic developer which contains an anisotropic magnetic material-dispersed resin carrier, wherein the anisotropic magnetic material-dispersed resin carrier contains:

magnetic particles; and a binder resin in which at least the magnetic particles are dispersed, wherein the anisotropic magnetic material-dispersed resin carrier has a magnetic anisotropy where magnetic fields of the magnetic particles are orientated in a same direction, and wherein the anisotropic magnetic material-dispersed resin carrier has a saturation magnetization of 16 emu/g to 30 emu/g, a coercive force of 15 kA/m to 40 kA/m, and a number average particle diameter of 15 μm or more but less than 100 μm.

13. The developing device according to claim 12, wherein the magnetic particles comprise a rare earth magnetic powder.

* * * * *